US010478889B2

(12) United States Patent
Honsel

(10) Patent No.: US 10,478,889 B2
(45) Date of Patent: Nov. 19, 2019

(54) METHOD FOR OPERATING AN ELECTRICALLY OPERATED PORTABLE RIVETING MACHINE, AND ELECTRICALLY OPERATED PORTABLE RIVETING MACHINE

(71) Applicant: VVG-BEFESTIGUNGSTECHNIK GMBH & CO., Neumuenster (DE)

(72) Inventor: Michael H. Honsel, Esgrus (DE)

(73) Assignee: VVG-BEFESTIGUNGSTECHNIK GMBH & CO., Neumuenster (DE)

( * ) Notice: Subject to any disclaimer, the term of this patent is extended or adjusted under 35 U.S.C. 154(b) by 187 days.

(21) Appl. No.: 15/382,754

(22) Filed: Dec. 19, 2016

(65) Prior Publication Data

US 2017/0173662 A1 Jun. 22, 2017

(30) Foreign Application Priority Data

Dec. 21, 2015 (DE) ..... 10 2015 122 374

(51) Int. Cl.

| | |
|---|---|
| ***B21J 15/04*** | (2006.01) |
| ***B21J 15/28*** | (2006.01) |
| ***B21J 15/10*** | (2006.01) |
| ***B21J 15/20*** | (2006.01) |

(Continued)

(52) U.S. Cl.

CPC ..... *B21J 15/043* (2013.01); *B21J 15/105* (2013.01); *B21J 15/205* (2013.01); *B21J 15/26* (2013.01); *B21J 15/28* (2013.01); *B21J 15/326* (2013.01); *Y10T 29/49943* (2015.01);

(Continued)

(58) Field of Classification Search

CPC ..... B21J 15/043; B21J 15/105; B21J 15/28; B21J 15/326; B21J 15/26; Y10T 29/49956; Y10T 29/49943; Y10T 29/5373; Y10T 29/53052; Y10T 29/53061

See application file for complete search history.

(56) References Cited

U.S. PATENT DOCUMENTS 4,754,643 A 7/1988 Weeks, Jr. et al.
5,035,353 A * 7/1991 Smart ..... B21J 15/105 227/112

(Continued)

FOREIGN PATENT DOCUMENTS

CN 104550616 A 4/2015
CN 104550619 A 4/2015

(Continued)

*Primary Examiner* — Jermie E Cozart
(74) *Attorney, Agent, or Firm* — Norman B. Thot

(57) ABSTRACT

A method for operating an electrically-operated portable riveting machine includes providing an electrically-operated portable riveting machine and informing the user when it is necessary to empty the collecting vessel. The electrically-operated portable riveting machine includes a housing, a rivet setting mechanism arranged in the housing which sets rivet elements into workpieces to be connected, a collecting vessel, a delivery duct that delivers spent rivet mandrels created during a setting of the rivet elements into the collecting vessel, a spent rivet mandrel determination device which determines a number of the spent rivet mandrels in the collecting vessel, and a user information device which informs a user when it is necessary to empty the collecting vessel.

13 Claims, 1 Drawing Sheet

(51) Int. Cl.
*B21J 15/26* (2006.01)
*B21J 15/32* (2006.01)

(52) U.S. Cl.
CPC .... *Y10T 29/49956* (2015.01); *Y10T 29/53052* (2015.01); *Y10T 29/53061* (2015.01); *Y10T 29/5373* (2015.01)

(56) References Cited

U.S. PATENT DOCUMENTS

| | | | | |
|---|---|---|---|---|
| 5,125,151 | A * | 6/1992 | Smart | B21J 15/28 173/20 |
| 8,443,512 | B2 * | 5/2013 | Masugata | B21J 15/043 29/243.521 |
| 2008/0012453 | A1 * | 1/2008 | Aasgaard | B21J 15/043 310/75 R |
| 2010/0139066 | A1 * | 6/2010 | Chen | B21J 15/043 29/243.53 |
| 2010/0257720 | A1 | 10/2010 | Schiffler et al. | |
| 2011/0289745 | A1 * | 12/2011 | Ho | B21J 15/043 29/243.526 |
| 2014/0244001 | A1 * | 8/2014 | Glickfield | H04L 67/16 700/33 |
| 2015/0336159 | A1 | 11/2015 | Gaertner et al. | |
| 2016/0136723 | A1 | 5/2016 | Skolaude | |
| 2016/0175920 | A1 * | 6/2016 | Scharfenberg | B21J 15/043 29/243.53 |

FOREIGN PATENT DOCUMENTS

| | | | | |
|---|---|---|---|---|
| CN | 104858351 | A | 8/2015 | |
| DE | 78 19 059 | U1 | 10/1978 | |
| DE | 81 19 147 | U1 | 10/1987 | |
| DE | 200 11 344 | U1 | 9/2000 | |
| DE | 100 11 305 | A1 | 9/2001 | |
| DE | 10 2007 059 422 | A1 | 6/2009 | |
| DE | 10 2011 111 535 | A1 | 2/2013 | |
| DE | 10 2013 012 075 | A1 | 1/2015 | |
| DE | 10 2013 221 789 | A1 | 4/2015 | |
| EP | 2 564 949 | A2 | 3/2013 | |
| JP | 2012-121026 | A | 6/2012 | |
| JP | 2012121026 | A * | 6/2012 | B21J 15/326 |
| JP | 5701028 | B2 * | 4/2015 | B21J 15/326 |

* cited by examiner

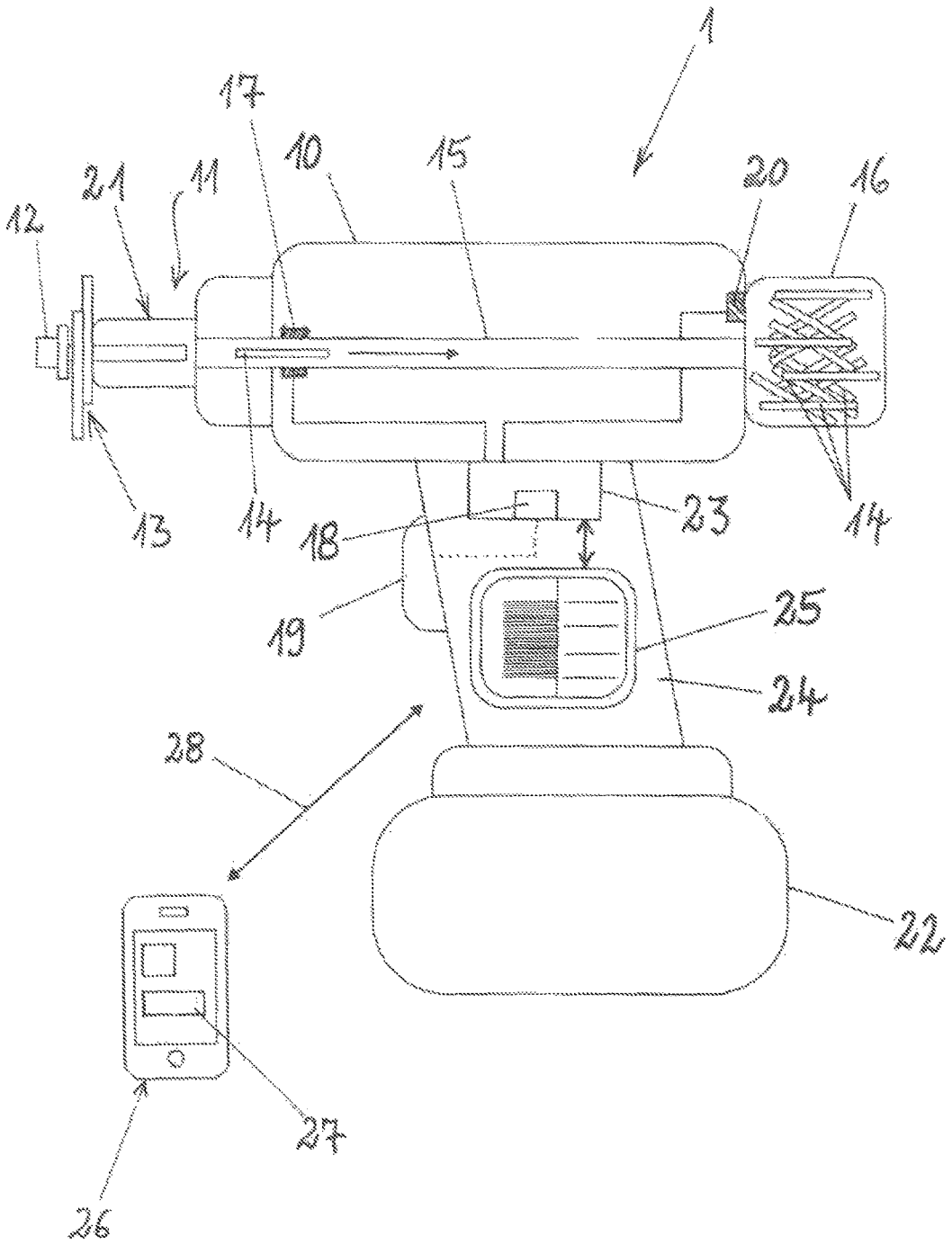
1
17
10
15
20
16
21
11
12
13
14
18
23
14
19
25
24
28
22
27
26

METHOD FOR OPERATING AN ELECTRICALLY OPERATED PORTABLE RIVETING MACHINE, AND ELECTRICALLY OPERATED PORTABLE RIVETING MACHINE

CROSS REFERENCE TO PRIOR APPLICATIONS

Priority is claimed to German Patent Application No. DE 10 2015 122 374.0, filed Dec. 21, 2015. The entire disclosure of said application is incorporated by reference herein.

FIELD

The present invention relates to a method for operating a hand-held electrically-operated, mobile riveting machine, and to the riveting machine itself, the riveting machine having a housing in which a rivet setting mechanism is accommodated with which rivet elements are set into workpieces to be connected, wherein spent rivet mandrels created during the setting of the rivet elements are delivered through a delivery duct of the riveting machine into a collecting vessel of the riveting machine.

BACKGROUND

A pneumatically-operated riveting machine is described, for example, in DE 81 19 147 U1. The riveting machine serves to set blind rivets in workpieces to be connected, parts of the rivet mandrel being broken off during rivet setting, and the collecting vessel serving to collect the broken-off spent rivet mandrels. Use is made of a delivery duct in order to transfer spent rivet mandrels from the front mouthpiece of the rivet setting mechanism into the collecting vessel arranged on the rear side of the housing of the riveting machine, a multiplicity of spent rivet mandrels being conducted through the delivery duct in the case of successively set rivet elements and being accommodated in the collecting vessel. It is thereby not possible to see into most collecting vessels for the spent rivet mandrels because the collecting vessel is produced, for example, from a nontransparent plastics material. The operator of the riveting machine must therefore regularly check whether the collecting vessel is already full. Even if a transparent collecting vessel is provided, emptying is frequently neglected and, if the collecting vessel is full, the spent rivet mandrels can no longer be discharged and block the delivery duct. The spent rivet mandrels therefore frequently become stuck in the delivery duct or in the collecting vessel. It is thereby possible for an unemptied collecting vessel to result in total loss of the riveting machine.

DE 10 2011 111 535 A1 describes another embodiment of a pneumatically-operated riveting machine where the riveting machine has, at its rear, a collecting vessel arranged on the housing, and a delivery duct which leads into the collecting vessel and through which the broken-off spent rivet mandrels can be moved, the delivery duct extending through the rivet setting mechanism starting from the mouthpiece. The collecting vessel can be opened via a rear closure in order to be emptied. The risk here exists that an unemptied collecting vessel will open by itself. This can result in potential injuries, for example, to the eyes, in particular during overhead riveting work.

DE 78 19 059 U1 describes a device for collecting and sucking away broken-off spent rivet mandrels of blind rivets for pneumatically-operated blind riveting machines having a passage duct in the machine head, the passage duct serving as a delivery duct for the spent rivet mandrels. The free end of the collecting vessel has a vacuum system which is operated by compressed air. The collecting and sucking away of the broken-off spent rivet mandrels functions easily and reliably, with the compressed air serving to transport the spent rivet mandrels. Such a negative-pressure system is not, however, usable in electrically-operated, in particular portable, riveting machines.

JP 2012-1210026 describes a pneumatically-operated riveting machine in which the accruing spent rivet mandrels are registered and brought to the user's attention.

DE 10 2013 012 075 A1 describes a pneumatically-operated riveting machine which is held by a robot arm and in which the spent rivet mandrels are delivered into a separately arranged collecting vessel via a hose. The number of spent rivet mandrels is thereby also determined.

DE 10 2013 221 789 A1 describes a battery-operated machine for setting rivets which can be manually operated where spent rivet mandrels are delivered into a collecting vessel arranged coaxially with the machine head. A ball screw for operating the machine head is provided in the axis between the machine head and the rivet mandrel container. The spent rivet mandrels are delivered to the rivet mandrel container via a duct.

SUMMARY

An aspect of the present invention is to provide a portable electrically-operated riveting machine and for a method of operating thereof where failure safety is improved. Another aspect of the present invention is to provide a riveting machine which is easier to use.

In an embodiment, the present invention provides a method for operating an electrically-operated portable riveting machine which includes providing an electrically-operated portable riveting machine and informing the user when it is necessary to empty a collecting vessel. The electrically-operated portable riveting machine includes a housing, a rivet setting mechanism arranged in the housing, the rivet setting mechanism being configured to set rivet elements into workpieces to be connected, a collecting vessel, a delivery duct configured so that spent rivet mandrels created during a setting of the rivet elements are delivered into the collecting vessel, a spent rivet mandrel determination device configured to determine a number of the spent rivet mandrels in the collecting vessel, and a user information device configured to inform a user when it is necessary to empty the collecting vessel.

BRIEF DESCRIPTION OF THE DRAWING

The present invention is described in greater detail below on the basis of embodiments and of the drawing in which:

FIG. 1 shows a schematic view of an electrically operated riveting machine for setting blind rivets of the present invention.

DETAILED DESCRIPTION

The present invention provides the technical teaching of providing a device via which the number of spent rivet mandrels in the collecting vessel is determined and where a user is informed whether it is necessary to empty the collecting vessel.

The quintessence of the present invention is the informing of the user of the electrically operated riveting machine, which can in particular be provided as a battery-operated machine, as to whether and when the collecting vessel has been filled with spent rivet mandrels and requires emptying. In order to provide the information, the present invention provides a device via which the number of spent rivet mandrels in the collecting vessel is determined. The user is informed that it is necessary to empty the collecting vessel if the number of spent rivet mandrels in the collecting vessel reaches a maximum permissible capacity of the collecting vessel. This information is not restricted to a currently-necessary emptying of the collecting vessel in the context of the present invention. The user can much rather also be informed when the collecting vessel will need to be emptied, for example, how many rivets can still be set until the collecting vessel is full.

In an embodiment of the present invention, the device comprises a sensing counting device with which the number of spent rivet mandrels delivered into the collecting vessel is counted and wherein a sum of spent rivet mandrels is formed so that the user is informed, via the sum formed, whether the collecting vessel requires emptying. If the sum of spent rivet mandrels has not yet reached the maximum capacity of the collecting vessel, the user is as a rule not informed. The user is only informed when the collecting vessel requires emptying. The user can also be informed, for example, of a number of rivet setting operations that are still possible before the capacity of the collecting vessel is reached. The user can thereby avoid interrupting the setting, for example, of a row of rivets, while also avoiding starting a new row before emptying the collecting vessel.

In an embodiment of the method according to the present invention, the device can, for example, comprise an electronic counting device with which the number of actuations of the riveting machine by the user is counted via an activation switch, and where the number of spent rivet mandrels delivered into the collecting vessel can advantageously being determined therefrom. The riveting machine can, for example, have a control unit, in particular when the riveting machine is embodied as an electrically-operated riveting machine, and in particular when the activation switch is configured in an electrically-acting manner. It is thus possible to use the control unit to easily determine the degree of filling of the collecting vessel without additional hardware components so that information relating to a current filling level of the collecting vessel can be output to the user of the riveting machine. The riveting machine can, for example, also have a display, it being possible to use the control unit to display on the display after how many rivet setting operations the collecting vessel will require emptying. A user is thereby supported in deciding whether a rivet setting sequence can still be carried out before the collecting vessel requires emptying.

In an embodiment of the present invention, the portable riveting machine can, for example, have a removal sensor with which removal of the collecting vessel from the housing of the riveting machine is detected, the count of spent rivet mandrels in the collecting vessel being zeroed following removal of the collecting vessel from the housing. The control unit can in particular be coupled to the removal sensor so that, for example, after a temporary removal of the collecting vessel, it is assumed that the latter has been emptied, and, by way of the control unit, the count of the spent rivet mandrels delivered into the collecting vessel can again start. It is necessary in this case for the user to in fact empty the collecting vessel when the collecting vessel is detached from the housing.

In an embodiment of the present invention, the riveting machine can, for example, be configured to communicate with a cell phone via a wireless connection so that information at least comprising the remaining number of riveting operations and/or the need to empty the collecting vessel is transmitted to the cell phone by the riveting machine and is displayed to the user on the cell phone via an app. The cell phone can, for example, vibrate or emit audible signals when an action by the user relating to the riveting machine is required, in particular with regard to the collecting vessel.

The present invention further provides a portable riveting machine having a housing in which a rivet setting mechanism is accommodated and via which rivet elements are settable into workpieces to be connected, the portable riveting machine having a delivery duct through which spent rivet mandrels produced during the setting of the rivet elements can be delivered into a collecting vessel of the riveting machine. The present invention provides a device via which the number of spent rivet mandrels in the collecting vessel can be determined and where provision is made for a user to be informed whether it is necessary to empty the collecting vessel.

In an embodiment of the present invention, the device can, for example, comprise a sensing counting device with which the number of spent rivet mandrels delivered into the collecting vessel can be counted. The device can additionally or alternatively comprise an electronic counting device with which the frequency of actuation of the riveting machine can be counted via an activation switch.

In an embodiment of the present invention, the riveting machine can, for example, have a removal sensor via which the removal of the collecting vessel from the housing of the riveting machine can be detected. In a further embodiment of the present invention, such removal sensors can, for example, serve to detect the arrangement of the collecting vessel so that, in interaction with the control unit of the riveting machine, the latter can only be operated when the removal sensor detects the presence of a collecting vessel. This provides for additional safety because spent rivet mandrels are prevented from passing into the open through the delivery duct via the rear side of the housing of the riveting machine and, for example, causing an eye injury to the user. Such removal sensors, which are provided in a manner known per se, serve to zero the count of the number of spent rivet mandrels in the collecting vessel when it is assumed that, during a temporary removal, the collecting vessel has also been emptied.

In an embodiment of the present invention, the portable riveting machine can, for example, have a display which is configured to display a remaining number of riveting operations until it is necessary to empty the collecting vessel. The display can, for example, be arranged in the form of a window on the housing of the riveting machine, for example, in the region of the handle, in the side region, or in the top region of an upper housing part in which the rivet setting mechanism is accommodated.

In an embodiment of the present invention, an unlocking device can, for example, be provided to manually unlock, via which unlocking device the collecting vessel is removed, the unlocking device being configured to light up or flash if it is necessary to empty the collecting vessel. The user is thus informed in a self-explanatory and in a particularly intuitive manner of those manipulations required to empty the collecting vessel. The riveting machine can in this case be configured for autonomous operation with a rechargeable battery. The rechargeable battery of the riveting machine in this case provides an electrical energy supply with which the method according to the present invention for operating the portable riveting machine can be carried out.

Further measures improving the present invention are illustrated in greater detail below under reference to the drawing.

FIG. 1 shows the electrically-operated riveting machine 1 having a housing 10 in which a rivet setting mechanism 11 is accommodated, the rivet setting mechanism 11 comprising a front mouthpiece 21 in which, for example, a rivet element 12 is accommodated. The rivet element in this case 12 serves to connect the workpieces 13 (which are indicated merely schematically). Located on the underside of the housing 10, as part thereof, is the handle 24 for portably holding the riveting machine 1, the handle 24 being adjoined by a rechargeable battery 22. The riveting machine 1 is thus embodied as an autonomously-working electric riveting machine 1 which is hand-held and operated by a user.

A collecting vessel 16 for the spent rivet mandrels 14 is located on the housing 10, on the rear side opposite the mouthpiece 21. The spent rivet mandrels 14 arise during rivet setting in that a part of the rivet mandrel or rivet pin is sheared off and is subsequently transferred into the collecting vessel 16 from the mouthpiece 21 via a delivery duct 15 oriented coaxially with the mouthpiece. To this end, the delivery duct 15 extends coaxially through the housing 10 and through the rivet setting mechanism 11 and forms a rectilinear, duct-like connection between the mouthpiece 21 and the collecting vessel 16. A spent rivet mandrel 14 is, for example, shown in a manner arranged in the delivery duct 15, the spent rivet mandrel 14 being delivered to the collecting vessel 16 through the delivery duct 15 in the direction illustrated by the arrow.

A sensing counting device 17 is located on the delivery duct 15 via which it is possible to detect how many spent rivet mandrels 14 are transferred into the collecting vessel 16. A removal sensor 20 is located in the region of the arrangement of the collecting vessel 16 on the housing 10. The removal sensor 20 serves to sense the arrangement of the collecting vessel 16 on the housing 10. It is possible via the removal sensor 20 to detect whether the collecting vessel 16 is arranged on the housing 10 or whether it has been removed. Such removal sensors 20 serve, in a manner known per se, to prevent the activation of the riveting machine 1 via the activation switch 19 if no collecting vessel 16 is located on the rear of the housing 10. Such a safety device is provided to prevent the operation of the riveting machine 1 without a collecting vessel 16 in order to prevent injuries to the user, for example, by preventing the spent rivet mandrels 14 from passing out of the rear of the housing 10.

A control unit 23 is also schematically shown in FIG. 1 which, in a manner known per se, is also a constituent part of a riveting machine 1. The control unit 23 serves to control the rivet setting mechanism 11. FIG. 1 shows that the sensing counting device 17 and the removal sensor 20 are connected to the control unit 23. Another electronic counting device 18 is also shown as a constituent part of the control unit 23, the number of set rivet elements 12 being able to be counted by the electronic counting device 18. An interaction arrow here indicates an operative connection to a display 25 which is arranged, for example, in the handle 24. It is possible via the display 25, for example, to display the classification of rivet elements 12 for which the operating mode of the riveting machine 1 is set to the user of the riveting machine 1. The display 25 can also display how many spent rivet mandrels 14 are already present in the collecting vessel 16 and whether or when the latter needs to be changed.

The sensing counting device 17 and the electronic counting device 18 are examples of a device via which, for example, the number of spent rivet mandrels 14 in the collecting vessel 16 can be determined and the user informed as to whether the emptying of the collecting vessel 16 is necessary. This information can be provided to the user, for example, via the display 25 or by sounding an audible signal. An additional light signal can also be output or haptic information provided to the user, for example, via a vibration device in the riveting machine 1.

The sensing counting device 17 in this case provides the information about the number of spent rivet mandrels 14 to the control unit 23, wherein the number is detected, for example, at the delivery duct 15. The detection via the sensing counting device 17 can in this case also take place at some other location, for example, within the rivet setting mechanism 11. The detection of the number of spent rivet mandrels 14 in the collecting vessel 16 via the electronic counting device 18 takes place via the number of actuations of the activation switch 19 so that no further sensor device is necessary since the number of set rivet elements 12 can be counted by a simple electronic count in the control unit 23. The count can be zeroed, for example, when the removal sensor 20 detects the removal of the collecting vessel 16 if it can be assumed that collecting vessel 16 has been emptied. The removal sensor 20 can also comprise a metallic detector which is able to detect whether no more spent rivet mandrels 14 in fact exist in the collecting vessel 16.

In an embodiment of the present invention, the control unit 23 can, for example, be configured to prevent the acceptance of the activation of the activation switch 19 when the collecting vessel 16 is full and requires emptying. This state can be displayed to the user via the display 25 so the user must empty the collecting vessel 16 before being able to continue with using the riveting machine 1.

FIG. 1 also shows a cell phone 26. The riveting machine 1 can be configured to communicate with the cell phone 26 via a wireless connection 28 so that information comprising at least the remaining number of riveting operations and/or the need to empty the collecting vessel 16 can be transmitted to the cell phone 26 by the riveting machine 1 and be displayed to the user on the cell phone 26 via an app 27.

It is also possible to inform the user as to how many rivet elements 12 can still be set before the collecting vessel 16 requires emptying via the display 25. This information can be provided, for example, by counting down the remaining rivet setting operations as displayed in the display 25.

The configuration of the present invention is not limited to the preferred exemplary embodiment specified above. A number of variants are rather conceivable which make use of the illustrated solution even in configurations of fundamentally different types. All features and/or advantages that are apparent from the claims, the description, or the drawings, including design details or spatial arrangements, can be important to the present invention both on their own and in a large variety of combinations. Reference should be had to the appended claims.

LIST OF REFERENCE NUMERALS

1 Riveting machine
10 Housing
11 Rivet setting mechanism
12 Rivet element

13 Workpiece
14 Spent rivet mandrel
15 Delivery duct
16 Collecting vessel
17 Sensing counting device
18 Electronic counting device
19 Activation switch
20 Removal sensor
21 Mouthpiece
22 Rechargeable battery
23 Control unit
24 Handle
25 Display
26 Cell phone
27 App
28 Wireless connection

What is claimed is:

1. A method for operating an electrically-operated portable riveting machine, the method comprising:

providing an electrically-operated portable riveting machine comprising:

a housing, a rivet setting mechanism arranged in the housing, the rivet setting mechanism being configured to set rivet elements into workpieces to be connected, a collecting vessel, a delivery duct configured so that spent rivet mandrels created during a setting of the rivet elements are delivered into the collecting vessel, an actuation switch, a spent rivet mandrel determination device configured to determine a number of the spent rivet mandrels in the collecting vessel, the spent rivet mandrel determination device comprising an electronic counting device which is configured to count a number of actuations of the electrically-operated portable riveting machine by the user via the activation switch so as to determine the number of the spent rivet mandrels delivered into the collecting vessel therefrom, and a user information device configured to inform a user when it is necessary to empty the collecting vessel; and informing the user when it is necessary to empty the collecting vessel.

2. The method as recited in claim 1, wherein, the spent rivet mandrel determination device further comprises a sensing counting device configured to count the number of the spent rivet mandrels delivered into the collecting vessel and to form a sum of the spent rivet mandrels, and based on the sum formed by the sensing counting device, informing the user via the user information device whether the collecting vessel requires emptying.

3. The method as recited in claim 1, wherein, the electrically-operated portable riveting machine further comprises a removal sensor which is configured to detect a removal of the collecting vessel from the housing, and the method further comprises:

zeroing a count of the spent rivet mandrels in the collecting vessel following a removal of the collecting vessel from the housing.

4. The method as recited in claim 3, wherein the user information device comprises a display which is configured to at least one of, display to the user whether and/or when it is necessary to empty the collecting vessel, and display to the user a remaining number of riveting operations before it is necessary to empty the collecting vessel.

5. The method as recited in claim 3, wherein the electrically-operated portable riveting machine is configured to communicate with a cell phone via a wireless connection so that information comprising at least one of a remaining number of riveting operations and a need to empty the collecting vessel is transmitted to the cell phone by the electrically-operated portable riveting machine and is displayed to the user on the cell phone via an app.

6. An electrically-operated portable riveting machine comprising:

a housing;

a rivet setting mechanism arranged in the housing, the rivet setting mechanism being configured to set rivet elements into workpieces to be connected;

a collecting vessel;

a delivery duct configured so that spent rivet mandrels created during a setting of the rivet elements are delivered into the collecting vessel;

an actuation switch;

a spent rivet mandrel determination device configured to determine a number of the spent rivet mandrels in the collecting vessel, the spent rivet mandrel determination device comprising an electronic counting device which is configured to count a number of actuations of the electrically-operated portable riveting machine by the user via the activation switch so as to determine the number of the spent rivet mandrels delivered into the collecting vessel therefrom; and a user information device configured to inform a user when it is necessary to empty the collecting vessel.

7. The electrically-operated portable riveting machine as recited in claim 6, wherein the spent rivet mandrel determination device further comprises a sensing counting device which is configured to count a number of the spent rivet mandrels delivered into the collecting vessel.

8. The electrically-operated portable riveting machine as recited in claim 6, further comprising a removal sensor configured to detect a removal of the collecting vessel from the housing of the riveting machine.

9. The electrically-operated portable riveting machine as recited claim 6, wherein the user information device comprises a display configured to display a remaining number of riveting operations until it is necessary to empty the collecting vessel.

10. The electrically-operated portable riveting machine as recited in claim 6, wherein the user information device comprises a signaling device configured to emit at least one of an optical signal, an acoustic signal and a haptic signal via which the user of the riveting machine is informed to empty the collecting vessel.

11. The electrically-operated portable riveting machine as recited in claim 6, further comprising a control unit configured to disable the electrically-operated portable riveting machine when it is necessary to empty the collecting vessel.

12. The electrically-operated portable riveting machine as recited in claim 6, wherein the user information device comprises a manual actuating device via which the collecting vessel is removed, the manual actuating device being configured to at least one of light up or flash when it is necessary to empty the collecting vessel.

13. The electrically-operated portable riveting machine as recited claim 6, further comprising a rechargeable battery, wherein the electrically-operated portable riveting machine is configured to provide an autonomous operation via the rechargeable battery.

* * * * *